US005440211A

United States Patent [19]

Jongen

[11] Patent Number: 5,440,211

[45] Date of Patent: Aug. 8, 1995

[54] ELECTRON ACCELERATOR HAVING A COAXIAL CAVITY

[75] Inventor: Yves Jongen, Louvain-La-Neuve, Belgium

[73] Assignee: Ion Beam Applications Societe Anonyme, Louvain-La-Neuve, Belgium

[21] Appl. No.: 142,448

[22] PCT Filed: May 27, 1992

[86] PCT No.: PCT/BE92/00023

§ 371 Date: Dec. 20, 1993

§ 102(e) Date: Dec. 20, 1993

[87] PCT Pub. No.: WO92/22190

PCT Pub. Date: Dec. 10, 1992

[30] Foreign Application Priority Data

May 29, 1991 [BE] Belgium ..... 09100516

[51] Int. Cl.[6] ..... H05H 7/00

[52] U.S. Cl. ..... 315/500; 315/507

[58] Field of Search ..... 328/289, 230, 233; 315/5.39, 5.41, 5.42, 500, 506, 507

[56] References Cited

U.S. PATENT DOCUMENTS 4,763,079 8/1988 Neil ..... 328/233

5,107,221 4/1992 N'Guyen et al. ..... 328/233

FOREIGN PATENT DOCUMENTS 0295981 12/1988 European Pat. Off. .

8809597 12/1988 WIPO .

OTHER PUBLICATIONS

Wielund et al, "Status & Future Development of the Wake Field Transformer Experiment," Nuclear Instruments & Methods in Physics Research, vol. A298, No. 1/3, Jan. 12, 1990.

*Primary Examiner*—Donald J. Yusko

*Assistant Examiner*—N. D. Patel

*Attorney, Agent, or Firm*—Chilton, Alix & Van Kirk

[57] ABSTRACT

A toroidal cavity-type electron accelerator is provided with a pair of electron beam sources. The beams from the two sources are respectively injected into the accelerating cavity at the mid-plane thereof and at a point displaced from the mid-plane whereby the electrons comprising the beam injected on the mid-plane will be accelerated while the electrons comprising the beam injected at the off mid-plane location will be decelerated and contribute their energy to producing a field for accelerating the electrons of the other beam.

7 Claims, 1 Drawing Sheet

ELECTRON ACCELERATOR HAVING A COAXIAL CAVITY

FIELD OF THE INVENTION

The present invention relates to improvements to electron accelerators, and more particularly to electron accelerators having an accelerating cavity defined by a pair of coaxial conductors.

DESCRIPTION OF THE PRIOR ART

Electron accelerators are generally known, having a resonant cavity supplied by a high-frequency field source commonly called the HF generator, and an electron source capable of injecting these electrons into the cavity. If certain phase and frequency conditions are respected, these electrons are accelerated by the electric field throughout their passage through the cavity.

These are in general machines working in the pulsed regime, and having relatively low beam intensities.

In document WO-A-88/09597 (Atomic Energy Commission), an electron accelerator with recirculation, of novel design, was proposed.

This document describes an electron accelerator which is characterized in that the resonant cavity is a coaxial cavity defined by an outer cylindrical conductor and an inner cylindrical conductor having the same axis. The electron beam is injected into this cavity in the mid plane which is perpendicular to the axis, along a first diameter. An electron deflector makes it possible to deflect the beam once it has passed through the cavity a first time, and reinject it back into the cavity where it undergoes a second acceleration, etc.

The above-described prior art device is also called a "rhodotron" because the electron beam passes through the cavity several times along a trajectory which describes the pattern of the petals of a flower.

The rhodotron has several advantages, namely that its shape is particularly simple and compact. In addition, the principle according to which the device functions makes it possible to obtain an intense and continuous beam, which was not the case with conventional devices working in the pulsed regime.

Furthermore, the rhodotron described is self-focusing due to the fact that the magnetic deflectors, which have input phases in the shape of very wide dihedra, provide suitable focusing of the electron beam. It is consequently not necessary to provide additional focusing elements.

Finally, the electron beam injected in the mid-plane of the rhodotron is not deviated. This is because the beam is not subjected to the magnetic field, which is zero in the mid-plane according to the configuration described in WO-A-88/09597.

However, a rhodotron requires the cavity to be supplied by a high-frequency field source. In particular, in the device described in WO-A-88/09597, an electric field of several hundreds of megahertz is generated by an external high-frequency generator.

High-frequency generators an output power of approximately 200 kW, which can create the requisite electric fields of several hundreds of megahertz, are relatively expensive devices. Such generators essentially use electron tubes of the triode, tetrode or pentode type, and use advanced, therefore expensive, techniques such as metal/ceramic welding, the use of refractory material grids or the use of thoriated tungsten filaments.

U.S. Pat. No. 4,763,079 describes a method for decelerating a particle beam, in which the energy produced by the deceleration of the particles is stored in order to be used for accelerating electrons in another accelerator.

OBJECT OF THE INVENTION

The object of the present invention is to provide a device which makes it possible to avoid the use of particularly expensive high-frequency generators, whilst retaining the advantages intrinsic to the original arrangement of the electron accelerator of the type described in document WO-A-88/09597.

SUMMARY OF THE INVENTION

The present invention relates to an electron accelerator, comprising:

- a first source emitting an electron beam to be accelerated,
- a coaxial cavity defined by an outer cylindrical conductor and an inner cylindrical conductor, of the same axis, the electron beam being injected in the mid-plane which is perpendicular to the axis, along a first diameter of the outer conductor, the accelerator being characterized in that it includes a second source emitting an electron beam, this electron beam being decelerated when it passes through the coaxial cavity, making it possible to produce the electromagnetic field necessary for accelerating the electron beam from the first source.

The second electron beam is injected into the coaxial cavity along a plane which is different from the mid-plane, which makes it possible to deflect the electrons towards the walls of the cavity and to remove them from this cavity.

The second electron beam source is provided with a device making it possible to modulate the intensity of the electrons emitted, in particular a control grid or a rearranger. Such devices are well known in devices which employ electron beams. The intensity of the electron beam is modulated such that the electrons from the second source appear in the cavity at the moment when they encounter a decelerating radial electric field. In this way, the electrons give up their kinetic energy to the electromagnetic field in the cavity and establish and maintain the electromagnetic field. The energy of the electrons injected by the second source is preferably chosen so that these electrons reach the wall of the cavity with a low but non-zero residual energy. In this way, the energy conversion between the electron beam and the cavity can reach values of 80 to 90%.

DESCRIPTION OF A PARTICULAR EMBODIMENT OF THE PRESENT INVENTION

Figure 1:
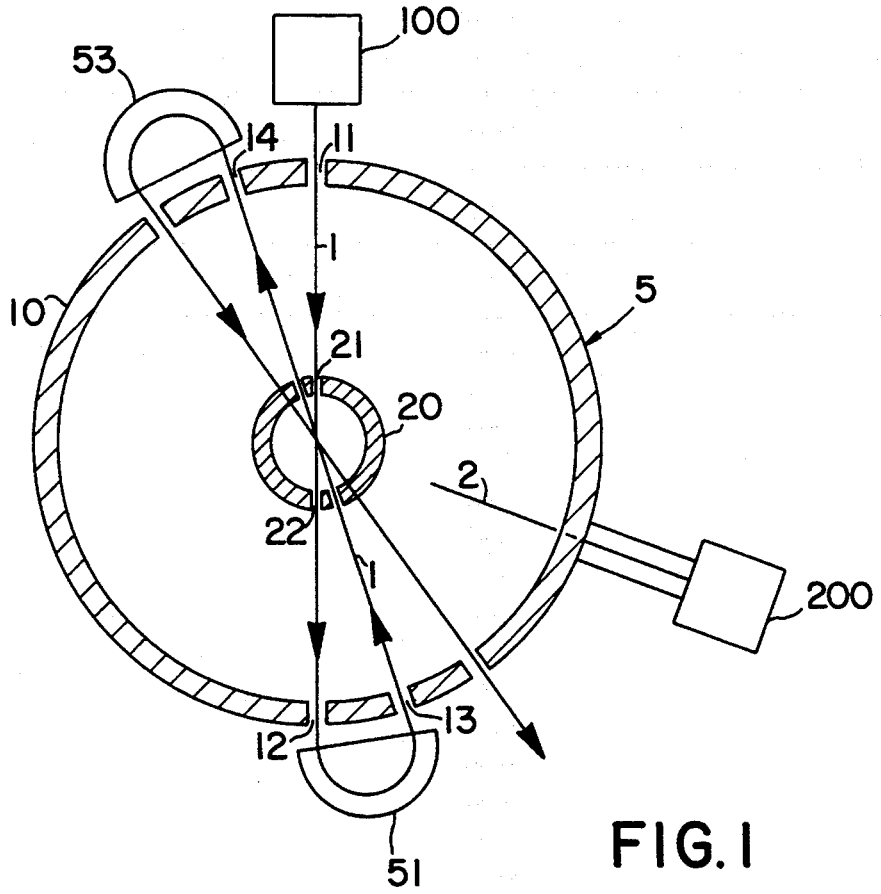
FIG. 1 represents a section along the mid-plane of an accelerator in accordance with the present invention, the accelerator having a coaxial cavity.

FIG. 1 represents a section along the mid-plane of the coaxial cavity of the electron accelerator according to the present invention.

The cavity 5 is defined by an outer cylindrical conductor 10 and an inner cylindrical conductor 20, of the same axis, and two flanges 15 and 25 (see FIG. 2) which are oriented perpendicularly with respect to the common axis 30 of the conductors.

According to this configuration, the electric field E is purely radial; it is maximum in the mid-plane 40 and decreases on either side of this plane to vanish at the flanges 15 and 25. Similarly, the magnetic field M is maximum along the flanges and vanishes in the mid-plane while changing polarity.

The principal electron beam 1 is injected from a source 100 into the coaxial cavity 5 along the mid-plane 40, and is not deflected because the magnetic field M at the point of injection is equal to zero.

The electron beam 1 penetrates into the cavity through an aperture 11 along a first diameter of the outer conductor 10; it traverses the inner conductor 20 by passing through two diametrically opposite apertures 21 and 22 and leaves the cavity through an aperture 12.

If certain phase and frequency conditions are satisfied, the principal beam 1 will be accelerated over its entire passage through the coaxial cavity 5.

In particular, it is suitable for the electric field E to vanish, i.e., to change polarity, when the beam passes through the inner conductor 20, so that the field causes acceleration during passage through the first part of the cavity (between the outer conductor 10 and the inner conductor 20), and again causes acceleration, being therefore opposite, during passage over the second part of the trajectory, that is to say between the inner conductor 20 and the outer conductor 10.

At least one deflector 51 is arranged outside the coaxial cavity 5. Deflector 51 deflects the principal electron beam 1 and reinjects it along a second diameter of the outer conductor 10. The principal beam is reintroduced to cavity 5 via an aperture 13 where it again undergoes acceleration and re-emerges through the aperture 14.

An electron beam exiting cavity 5 via aperture 14 may be again deflected by a deflector 53 and reinjected along a third diameter into the cavity, where it will undergo a third acceleration, etc.

The magnetic deflectors 51, 53, . . . advantageously have input faces in the shape of a very wide dihedron, so as to focus the principal electron beam 1.

Figure 2:
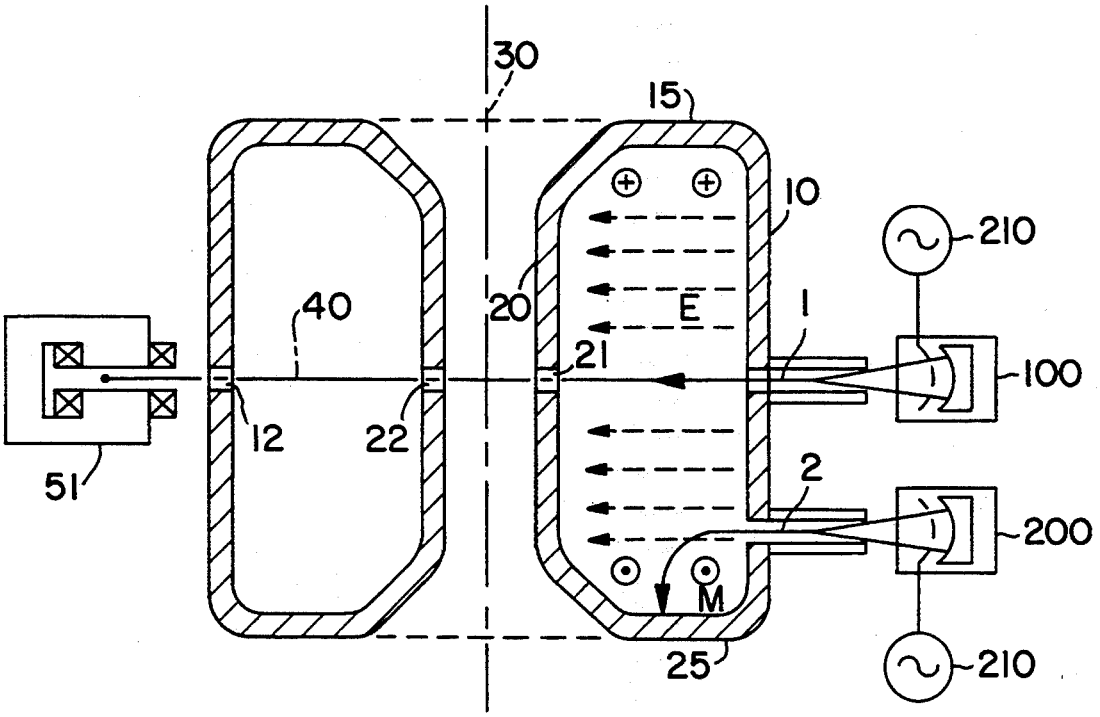
FIG. 2 represents a cross-sectional view of the accelerator of FIG. 1, FIG. 2 being a view taken parallel to the principal axis of the coaxial cavity of an electron accelerator according to the present invention.

FIG. 2 represents a cross-sectional view taken perpendicular to FIG. 1, i.e., in a direction parallel to the principal axis of the coaxial cavity.

According to the principal characteristic of the present invention, the electron accelerator having a coaxial cavity includes a second electron beam source 200 which is provided with a device 210 for modulating the beam intensity. Source 200 emits an electron beam 2 which will be injected into the cavity 5 at the moment when the electric field E causes its deceleration. This makes it possible to generate the electromagnetic field necessary for accelerating the first electron beam 1.

The kinetic energy loss of the electron which is decelerated makes it possible to create a high-frequency electromagnetic field in the coaxial cavity 5.

Preferably, the second electron beam 2 is injected into the coaxial cavity 5 along a plane which is different from the mid-plane 40. The result of this is that the electrons comprising beam 2 will be deflected towards the walls of the cavity, which allows them to be removed from the cavity.

The electrons comprising beam 2 are not slowed to rest in the cavity itself thereby ensuring that the electrons will not be subjected, in the opposite direction, to the acceleration of the electromagnetic field and reaccelerated.

Restated, it is necessary for the electrons from the secondary beam 2 still to have some degree of residual kinetic energy, so as to reach the walls of the cavity 5.

Because of this, the degree of conversion of the kinetic energy of the electrons into electromagnetic energy is limited to values of from 80 to 90%.

The present invention makes it possible not to have to resort to using external high-frequency generators, which are particularly expensive devices. In fact, they represent approximately 30% of the total cost of an electron accelerator.

Furthermore, the structure of an accelerator according to the present invention is simplified, which provides a non-negligible improvement in the reliability of the electron accelerator.

I claim:

1. An electron accelerator comprising:

a first source for generating a first beam of electrons to be accelerated;

a cavity defined by an outer cylindrical conductor and an inner cylindrical conductor, said conductors being coaxial and being joined by flanges at their opposite ends, said cavity having a mid-plane disposed substantially equidistantly from said flanges, said mid-plane being oriented perpendicular with respect to the axis of said conductors, said first electron beam being injected into said cavity at said mid-plane along a first diameter of said outer conductor;

a second source for generating a second beam of electrons, said second electron beam being decelerated when it passes through said cavity to thereby provide an electromagnetic field necessary for accelerating said first electron beam.

2. The electron accelerator according to claim 1, characterized in that said second electron beam is injected into said cavity along a plane which is different from said mid-plane, thus allowing the electrons comprising said second beam to be deflected towards the walls of said cavity.

3. The electron accelerator according to claim 1, characterized in that said second electron beam source includes means for modulating the intensity of said second electron beam.

4. The electron accelerator according to claim 1, further comprising at least one electron deflector positioned outside of said cavity, said one deflector intercepting said first electron beam after passage through said cavity along said first diameter and deflecting said first beam, said deflected first beam being reinjected into said cavity at said mid-plane along a second diameter of said outer conductor.

5. The electron accelerator according to claim 2, characterized in that said second electron beam source includes means for modulating the intensity of said second electron beam.

6. The electron accelerator according to claim 2, further comprising at least one electron deflector positioned outside of said cavity, said one deflector intercepting said first electron beam after passage through said cavity along said first diameter and deflecting said first beam, said deflected first beam being reinjected into said cavity at said mid-plane along a second diameter of said outer conductor.

7. The electron accelerator according to claim 3, further comprising at least one electron deflector positioned outside of said cavity, said one deflector intercepting said first electron beam after passage through said cavity along said first diameter and deflecting said first beam, said deflected first beam being reinjected into said cavity at said mid-plane along a second diameter of said outer conductor.

* * * * *